US012746443B2

(12) United States Patent
Nichols

(10) Patent No.: US 12,746,443 B2
(45) Date of Patent: Sep. 29, 2026

(54) GAME BOARD FOR CORNHOLE

(71) Applicant: Tupelo Goods, LLC, Austin, TX (US)

(72) Inventor: Steve Charles Nichols, Austin, TX (US)

(73) Assignee: Tupelo Goods, LLC, Austin, TX (US)

( * ) Notice: Subject to any disclaimer, the term of this patent is extended or adjusted under 35 U.S.C. 154(b) by 192 days.

(21) Appl. No.: 17/230,828

(22) Filed: Apr. 14, 2021

(65) Prior Publication Data

US 2022/0331676 A1 Oct. 20, 2022

(51) Int. Cl.
*A63B 67/06* (2006.01)
*A63B 63/08* (2006.01)

(52) U.S. Cl.
CPC ..... *A63B 67/06* (2013.01); *A63B 63/08* (2013.01); *A63B 2210/50* (2013.01)

(58) Field of Classification Search
CPC ..... A63B 67/06; A63B 63/08; A63B 2210/50; A63B 2067/061
USPC ..... 273/398–402
See application file for complete search history.

(56) References Cited

U.S. PATENT DOCUMENTS 3,178,184 A * 4/1965 Glassman ..... A63D 3/00 273/108
5,382,022 A * 1/1995 Cook ..... A63B 67/14 273/126 R
6,866,268 B2 3/2005 Christianson
7,607,666 B1 10/2009 Studier
D621,881 S 8/2010 Youngberg et al.
D635,197 S 3/2011 Pryor
8,069,795 B1 * 12/2011 Williams ..... A47B 7/02 108/115
8,162,318 B1 * 4/2012 Peterson ..... A63B 67/06 273/343
D729,319 S 5/2015 Meissner et al.
9,381,414 B1 7/2016 Gatton et al.
11,173,363 B1 11/2021 Pontrelli
D955,482 S 6/2022 Turner
D966,415 S 10/2022 Zhuang
2006/0125186 A1 * 6/2006 Digges, III ..... A63B 67/06 273/402
2008/0042360 A1 * 2/2008 Veikley ..... A63B 67/06 273/398
2008/0295745 A1 * 12/2008 Hamilton ..... A47B 13/06 108/50.02
2009/0295093 A1 * 12/2009 Kiernan ..... A63B 67/06 273/317.2
2013/0082442 A1 4/2013 Hanel
2014/0151963 A1 6/2014 Bennett
2015/0108719 A1 * 4/2015 Devine ..... A63B 67/06 273/402
2017/0138586 A1 5/2017 Finch et al.
2018/0043227 A1 2/2018 Segerstrom
(Continued)

*Primary Examiner* — Joseph B Baldori
*Assistant Examiner* — Christopher Glenn
(74) *Attorney, Agent, or Firm* — Banner & Witcoff, Ltd.

(57) ABSTRACT

A cornhole board assembly is disclosed that may have a base and a removable and/or interchangeable playing board. The base may be formed from metallic materials while the playing board may be formed from primarily non-metallic materials. The cornhole board assembly may include damping elements arranged between the base and the playing board. Depending on the playing board attached, the cornhole board assembly may have different playing characteristics.

20 Claims, 7 Drawing Sheets

(56) References Cited

U.S. PATENT DOCUMENTS

| | | | | |
|---|---|---|---|---|
| 2018/0085649 | A1* | 3/2018 | O'Neill | A63B 67/06 |
| 2019/0381379 | A1* | 12/2019 | Angel | A63B 67/06 |
| 2020/0001158 | A1* | 1/2020 | Poetter | A63B 67/06 |
| 2021/0308550 | A1 | 10/2021 | Li | |
| 2022/0331676 | A1 | 10/2022 | Nichols | |

* cited by examiner

GAME BOARD FOR CORNHOLE

FIELD OF INVENTION

This disclosure relates to game boards for cornhole and cornhole game sets.

BACKGROUND

Cornhole is a game enjoyed by many people. The game is played by players taking turns throwing bags toward a cornhole board with the object to get the bags to fall within a hole located on the cornhole board. Cornhole may be played indoors or outdoors and as such the cornhole board may be exposed different environments.

BRIEF SUMMARY

Aspects of this disclosure may relate to a cornhole board assembly comprising: a base that includes a plurality of legs that support the base and a frame connected to the plurality of legs and a playing board comprising a non-metallic material that is releasably connected to the base, where the playing board includes a circular hole. The frame may have a generally rectangular shape surrounding an opening, where the frame has a front wall having a first length and a first side wall adjacent to the front wall having a second length, a rear wall opposite the front wall, and a second side wall opposite the first side wall, and where the second length may be longer than the first length. The plurality of legs and the frame may be formed from a metallic material. The cornhole board assembly may further include a first plurality of damping elements positioned between the frame and the playing board. The base may further include a support beam extending across the opening from the first side wall to the second side wall, where the support beam comprises two support beams extending from the first side wall to the second side wall. The cornhole board assembly may further comprise a second plurality of damping elements positioned between the support beam and the playing board, where a first damping element and a second damping element of the second plurality of damping elements are spaced apart from each other along the support beam. The plurality of legs may include a pair of front legs and a pair of rear legs, where the pair of front legs are shorter than the pair of rear legs. Each leg of the plurality of legs may include a foot, where the foot may be formed from an elastomeric material. The non-metallic material of the playing board may include a wooden material or may include a polymer material.

Other aspects of this disclosure may relate to a cornhole board assembly comprising: (a) a base that includes a plurality of legs that support the base and a frame connected to the plurality of legs, (b) a first playing board comprising a first non-metallic material, where the first playing board includes a circular hole and has a first set of playing characteristics that includes a first playing board weight, and (c) a second playing board comprising a second non-metallic material, wherein the second playing board includes a circular hole and has a second set of playing characteristics that includes a second playing board weight that is different than the first playing board weight. Either the first playing board and the second playing board is selectably mounted to the base such that when the first playing board is mounted to the base, the cornhole board assembly has the first set of playing characteristics, and when the second playing board is mounted the base such that when the first playing board is mounted to the base, the cornhole board assembly has the second set of playing characteristics. The frame may have a generally rectangular shape surrounding an opening, where the frame comprises a front wall having a first length and a first side wall adjacent to the front wall having a second length, a rear wall opposite the front wall, and a second side wall opposite the first side wall, and where the second length may be longer than the first length. The plurality of legs and the frame may be formed from a metallic material. The base may further include a support beam that extends across the opening from the first side wall to the second side wall. In some examples, the support beam may comprise two support beams that extend across the opening from the first side wall to the second side wall. The second playing board weight may be at least 1.5 times heavier than the first playing board weight. The first non-metallic material may comprise a wooden material, and the second non-metallic material may comprise a polymer material.

Still other aspects of this disclosure may relate to a cornhole board assembly that comprises: a base that includes: (a) a plurality of legs that support the base, where the plurality of legs includes a pair of front legs and a pair of rear legs, and the pair of front legs are shorter than the pair of rear legs; (b) a frame connected to the plurality of legs and having a generally rectangular shape surrounding an opening, where the frame may include a front wall having a first length and a first side wall adjacent to the front wall having a second length, a rear wall opposite the front wall, and a second side wall opposite the first side wall, and where the second length may be longer than the first length; and (c) a support beam extending across the opening from the first side wall to the second side wall, a playing board that is releasably connected to the base, where the playing board includes a circular hole, a first plurality of damping elements positioned between the frame and the playing board, and a second plurality of damping elements positioned between the support beam and the playing board. The plurality of legs and the frame may be formed from a metallic material. In some examples, the base may further include a second support beam that extends from the front wall across at least a portion of the opening. The cornhole board assembly may also include a first damping element and a second damping element of the second plurality of damping elements are spaced apart from each other along the support beam.

BRIEF DESCRIPTION OF THE DRAWINGS

The present invention is illustrated by way of example and not limited in the accompanying figures in which like reference numerals indicate similar elements and in which.

Figure 1:
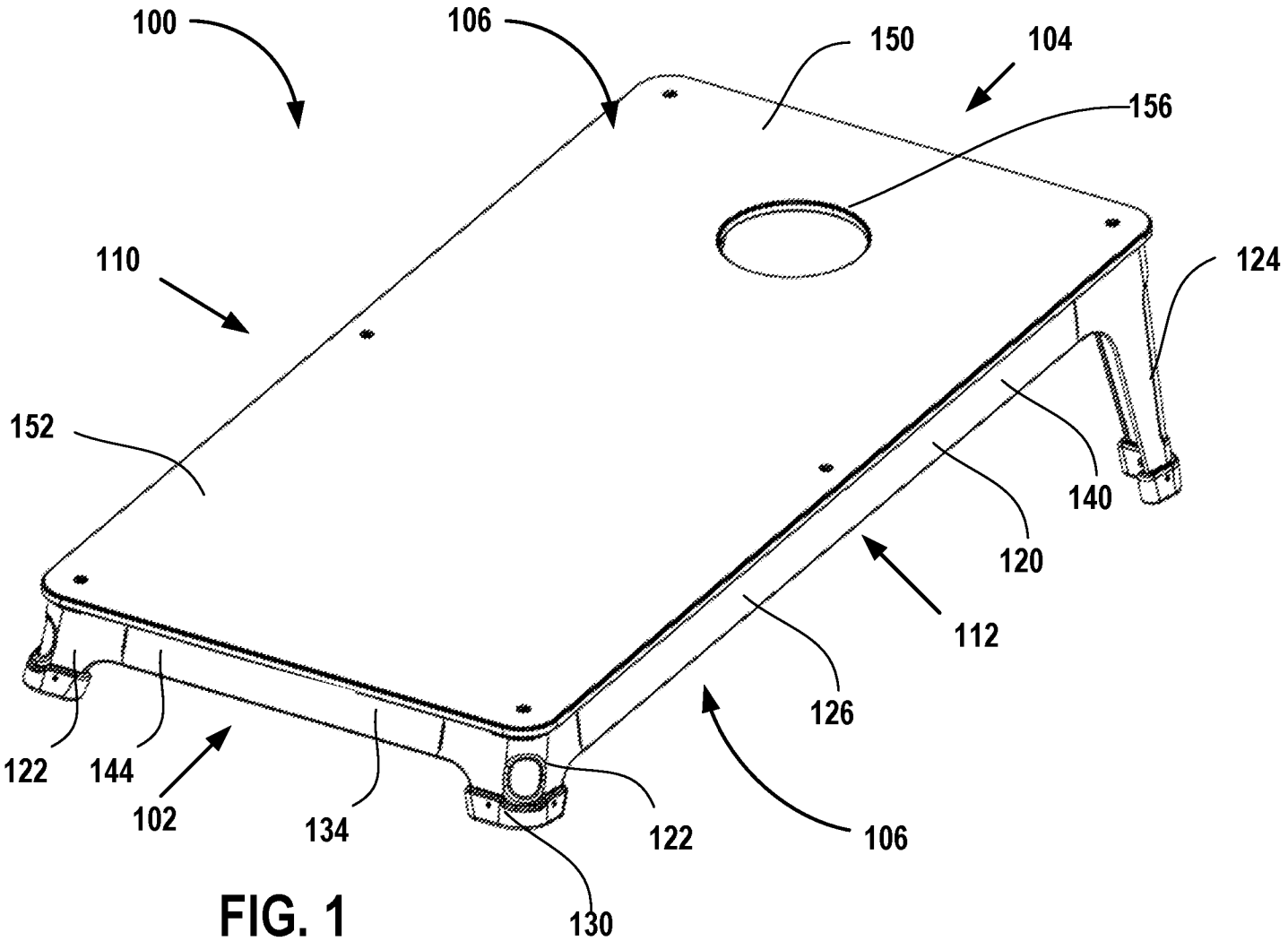
FIG. 1 illustrates a front top perspective view of an exemplary cornhole board assembly according to one or more aspects described herein.

Further, it is to be understood that the drawings may represent the scale of different components of one single embodiment; however, the disclosed embodiments are not limited to that particular scale.

DETAILED DESCRIPTION

In the following description of various example structures of a cornhole board assembly, reference is made to the accompanying drawings, which form a part hereof, and in which are shown by way of illustration various example devices, systems, and environments in which aspects of the cornhole board assembly may be practiced. It is to be understood that other specific arrangements of parts, example devices, systems, and environments may be utilized and structural and functional modifications may be made without departing from the scope of the present invention. Also, while the terms "top," "bottom," "front," "side," "rear," and the like may be used in this specification to describe various example features and elements of the cornhole board assembly, these terms are used herein as a matter of convenience, e.g., based on the example orientations shown in the figures or the orientation during typical use. Nothing in this specification should be construed as requiring a specific three-dimensional orientation of structures in order to fall within the scope of this disclosure. Also, the reader is advised that the attached drawings are not necessarily drawn to scale.

Additionally, the term "plurality," as used herein, indicates any number greater than one, either disjunctively or conjunctively, as necessary, up to an infinite number.

"Generally parallel," as the term is used herein, means that a first line, segment, plane, edge, surface, etc. is approximately (in this instance, within 5%) equidistant from with another line, plane, edge, surface, etc., over at least 50% of the length of the first line, segment, or edge, or over at least 50% of the area of the plane or surface, etc. In some examples, lines, segments, or edges may be considered "generally parallel" if one such a line, segment, or edge is approximately equidistant (±5%) to another respective line, segment, or edge over at least 60%, at least 75%, at least 85%, at least 90%, or even at least 95% of a length of either of the lines, segments, or edges being considered. Additionally, planes or surfaces may be considered "generally parallel" if one plane or surface is approximately equidistant (±5%) to another respective plane or surface over at least 60%, at least 75%, at least 85%, at least 90%, or even at least 95% of a surface area of either of the planes or surfaces being considered.

"Generally perpendicular," as the term is used herein, means that a first line, segment, plane, edge, surface, etc. is approximately (in this instance, within 5%) orthogonal from with another line, plane, edge, surface, etc., over at least 50% of the length of the first line, segment, or edge, or over at least 50% of the area of the plane or surface, etc. In some examples, lines, segments, or edges may be considered "generally perpendicular" if one such a line, segment, or edge is approximately orthogonal (±5%) to another respective line, segment, or edge over at least 60%, at least 75%, at least 85%, at least 90%, or even at least 95% of a length of either of the lines, segments, or edges being considered. Additionally, planes or surfaces may be considered "generally perpendicular" if one plane or surface is approximately orthogonal (±5%) to another respective plane or surface over at least 60%, at least 75%, at least 85%, at least 90%, or even at least 95% of a surface area of either of the planes or surfaces being considered.

In general, aspects of this disclosure relate a game board for playing cornhole, i.e. a cornhole board assembly. As shown in FIGS. 1-9, the cornhole board assembly 100 may have a front side 102, a rear side 104 opposite the front side 102, a top side 106, a bottom side 108 opposite the top side 106, a left side 110 extending between the front side 102 and the rear side 104, and a right side 112 opposite the left side 110. The cornhole board assembly 100 may include a base 120 and a playing board 150 that is releasably or permanently connected to the base 120. The base 120 may include a pair of front legs 122 near the front side 102, a pair of rear legs 124 near the rear side 104, and a frame 126 that is connected to the plurality of legs 122, 124. The legs 122, 124 may support the base 120 on a flat surface (i.e. such as the ground or other suitable platform). A plurality of feet 130 may attach to a distal end 132 of each leg 122, 124, where each foot 130 may provide a ground engaging surface 133 to prevent slipping or movement of the cornhole board assembly 100 during play. The playing board 150 may be releasably connected to the frame 126 using a plurality of mechanical elements, such as threaded mechanical fasteners, clips, cam lock fittings, or other suitable mechanical means known to own skilled in the art. Alternatively, the playing board 150 may be permanently attached to the base 120 using an adhesive or other permanent joining technique. In addition, a plurality of damping elements 170 may be located between the playing board 150 and the base 120 to help improve the sound and dampen any vibration between the board 150 and the base 120.

The base 120 may further include a frame 126, where the frame is configured to releasably connect to the playing board 150. The frame 126 may surround an opening 128 and have a front wall 134, a rear wall 136 opposite the front wall 134, a first side wall 138 extending between the front wall 134 and the rear wall 136, and a second side wall 140 opposite the first side wall 138 that extends between the front wall 134 and the rear wall 136. The front wall 134 may be generally parallel with the rear wall 136 and generally perpendicular with the side walls 138, 140. The frame 126 may have a generally rectangular shape such that the side walls 138, 140 are longer than the front and rear walls 134, 136. Each wall 134, 136, 138, 140 may include a flange portion 142 that extends inward toward the opening 128 and a substantially downward extending portion 144 that extends downward from the flange portion 142. The downward extending portion 144 may form an outboard facing surface 146 of each wall 134, 136, 138, 140. The flange portion 142 of each wall 134, 136, 138, 140 may include the connecting means to releasably connect the playing board 150, such as a threaded hole or other means known to one skilled in the art. When the playing board 150 is removed, a plurality of bases 120 may stack together for ease of storage and shipping.

The base 120 may include a pair of front legs 122 and a pair of rear legs 124. The plurality of legs 122, 124 may be integrally formed with the frame 126 or formed separately and permanently joined to the frame 126. Each leg 122, 124 may be formed to extend from and connect to at least two adjacent walls 134, 136, 138, 140 of the frame 126. In short, each leg 122, 124 may have portions that extend in different directions. For example, front leg 122A extends from and connects to both front wall 134 and first side wall 138, and rear leg 124A extends from and connect to both rear wall 136 and first side wall 138. Alternatively or optionally, each leg 122, 124 may extend from only a single wall 134, 136, 138, 140 or the base 120 may have a combination where some legs connect to two walls and some legs connect to only a single wall of the frame 126.

The front legs 122 may be shorter than the rear legs 124 to place the frame 126 and playing board 150 at an appropriate angle for game play. For examples, the angle of playing board 150 may be within a range of 15 to 25 degrees. In some examples, the rear legs 124 may be sized to place the top surface 152 of the playing board at a height of approximately 12 inches from the ground engaging surface 133 of the foot 130 and the lower legs 122 may be sized to place the top surface 152 of the playing board 150 at a height of 4 inches from the ground engaging surface 133 of the foot 130.

To prevent the playing board 150 from moving during play, each leg 122, 124 may have a foot 130 that is attached. The foot 130 may conform to the size of each leg 122, 124 and attach to a distal end 132 of each leg 122, 124 and provides a ground engaging surface 133. Each foot 130 may be formed from a material that is different than the material of the legs 122, 124 or frame 126, such as elastomeric or resilient material. The elastomeric material helps to increase the friction between the ground engaging surface 133 and the ground or platform supporting the cornhole board assembly 100. In some examples, the ground engaging surface 133 may have traction elements or a texture to further prevent movement of the cornhole board assembly 100 during play. The feet 130 may be attached to the legs 122, 124 using an adhesive, a press fit, mechanical fasteners or other means known to one skilled in the art.

Figure 2:
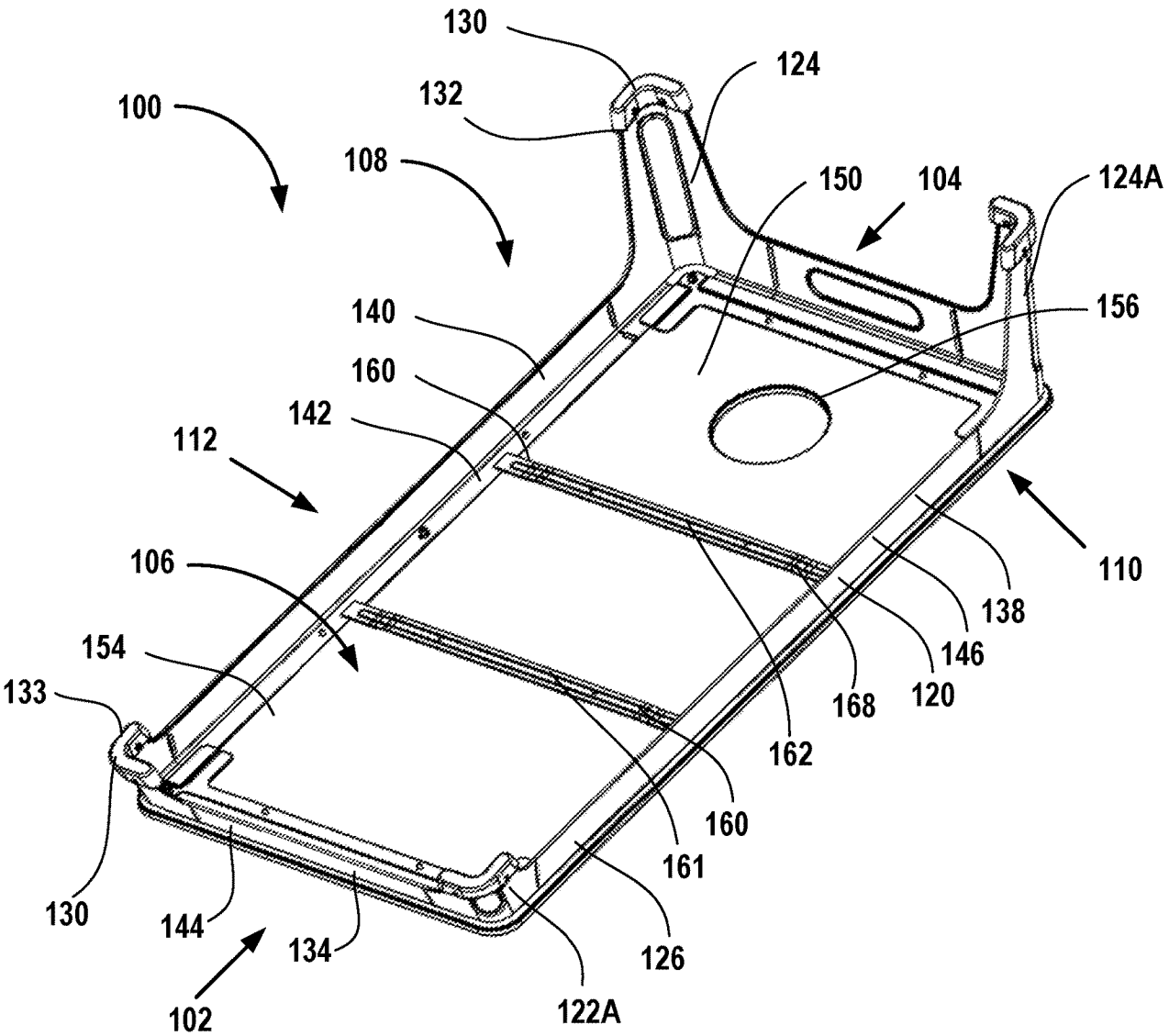
FIG. 2 illustrates a front bottom perspective view of the exemplary cornhole board assembly of FIG. 1 according to one or more aspects described herein.
Figure 3:
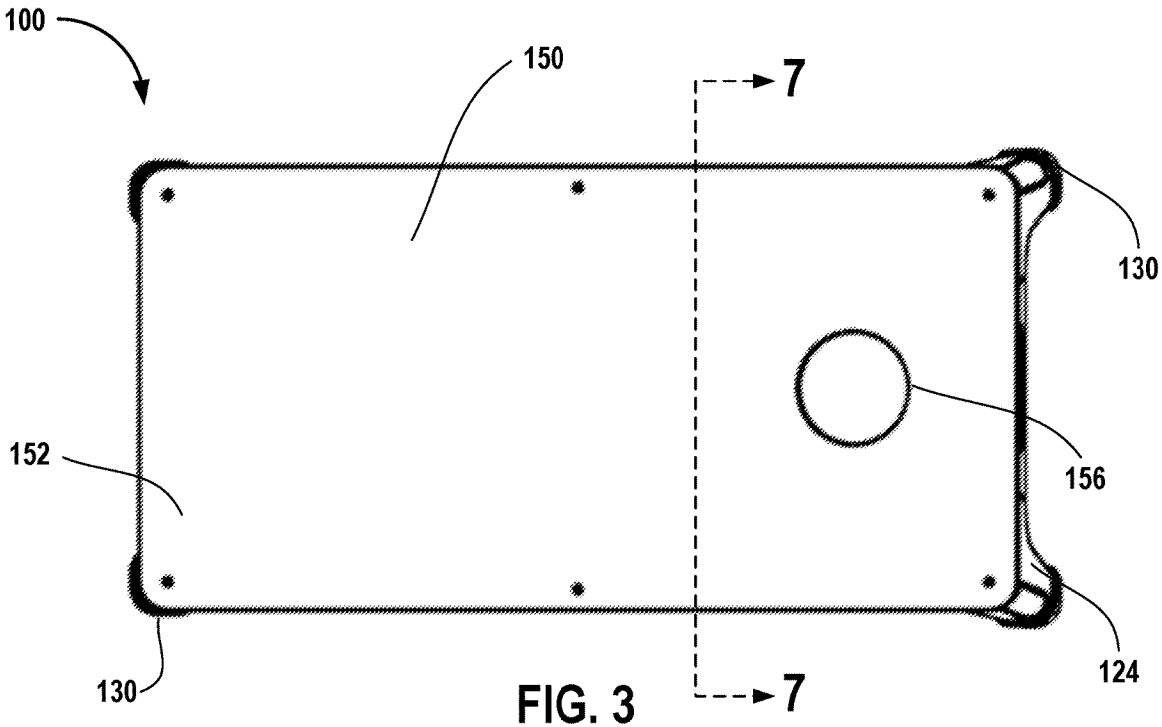
FIG. 3 illustrates a top view of the exemplary cornhole board assembly of FIG. 1 according to one or more aspects described herein.
Figure 4:
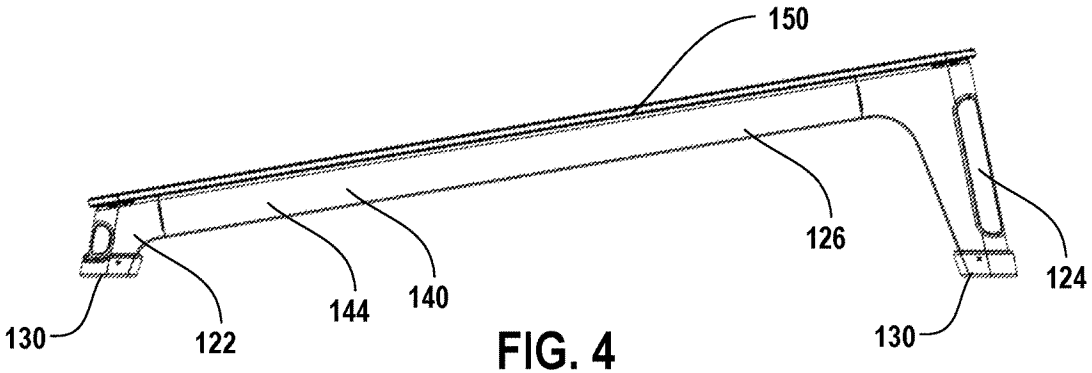
FIG. 4 illustrates a right side view of the exemplary cornhole board assembly of FIG. 1 according to one or more aspects described herein.
Figure 5:
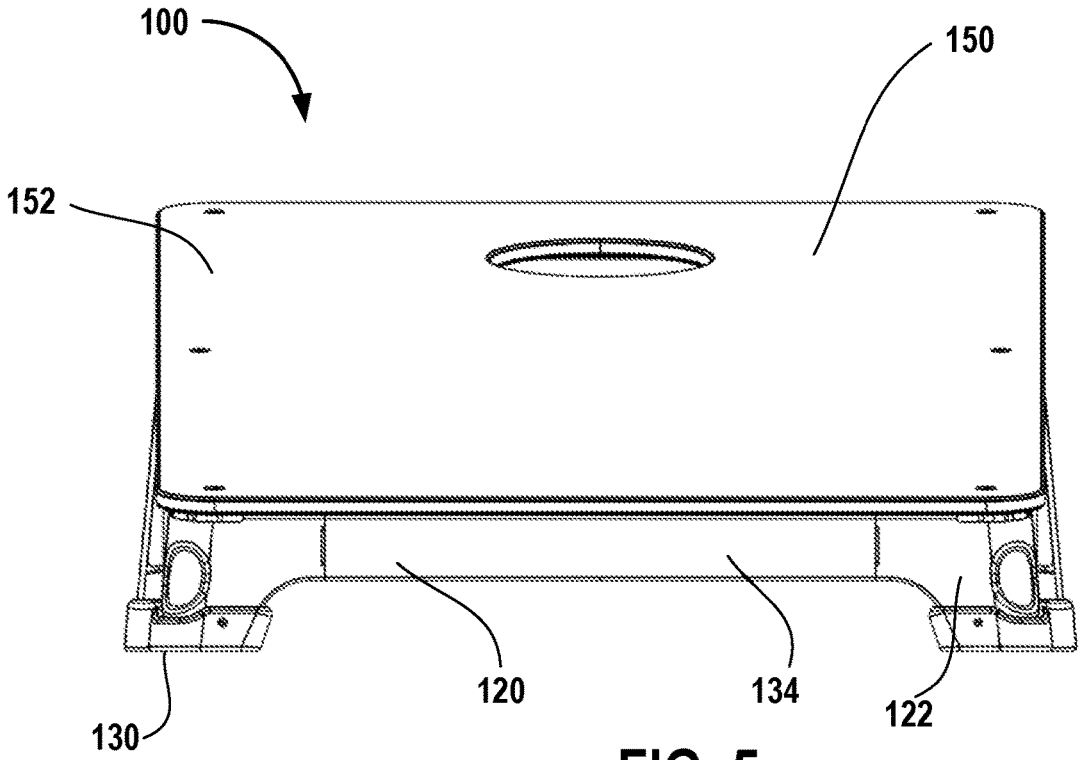
FIG. 5 illustrates a front view of the exemplary cornhole board assembly of FIG. 1 according to one or more aspects described herein.
Figure 6:
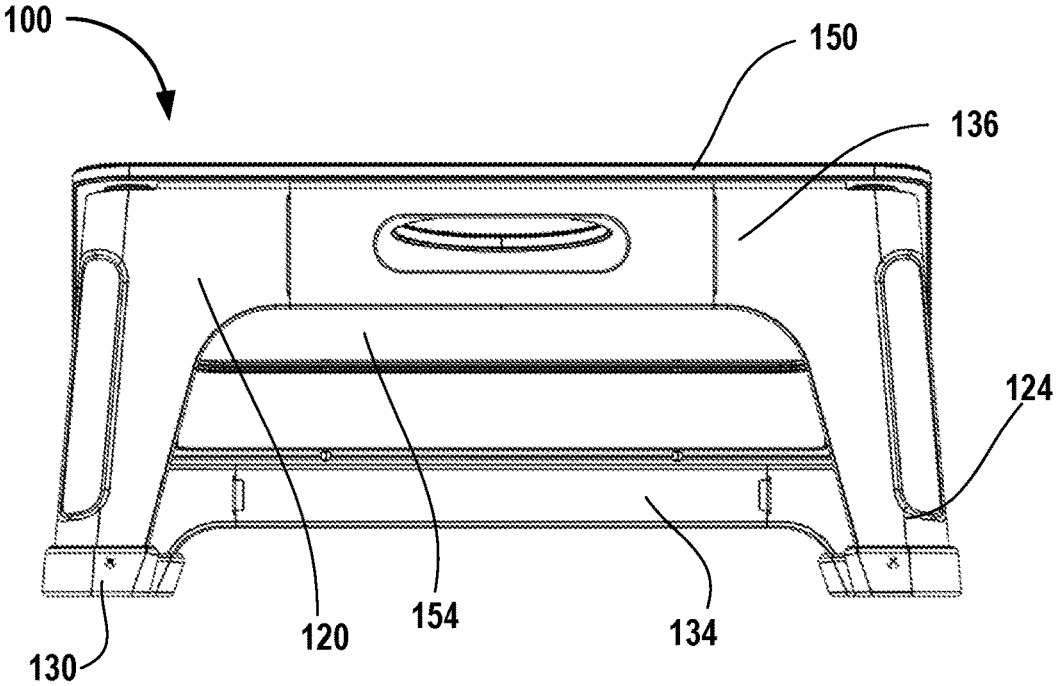
FIG. 6 illustrates a rear view of the exemplary cornhole board assembly of FIG. 1 according to one or more aspects described herein.

In addition, the base 120 may include a plurality of support beams 160 that extend across the opening 128 of the frame 126. As shown in FIG. 2, the support beams 160 may extend from the first side wall 138 to the second side wall 140. The support beams 160 may provide additional stiffness to the frame 126 to help it keep its shape and prevent any deformation through use or transport. Optionally, the frame 126 may include one or more support beams 160 that extends from the front wall 134 across at least a portion of the opening 128 of the frame 126 towards or connected to the rear wall 136. As such the base 120 may include one or more support beams 160 that are oriented generally perpendicular to each other and have at least one support beam 160 that extends from the front wall 134 to the rear wall 136 and at least one support beam 160 that extends from the first side wall 138 to the second side wall 140. Each support beam 160 may be permanently connected to the flange portion 142 of each respective frame wall that it is attached. While the illustrated exemplary base 120 has two support beams 160, the base 120 may have only a single support beam 160 or may have more than two support beams 160, such as 3, 4, 5 or more support beams 160. As another option, a supplemental support beam (not shown) may extend from one of the walls 134, 136, 138, 140 of the frame 126 across a portion of the opening 128 to a support beam 160 or may extend between different support beams 160 to help provide additional stiffness to the base 120 as desired.

Each support beam 160 may include a rib or stiffening region 162 to help increase the rigidity and stiffness of the support beam 160. The rib 162 may extend along a majority of the overall length of the support beam 160. The beam may also include an upper surface 164 that is spaced a predetermined distance from a bottom surface 154 of the playing board 150. In some examples, the support beam 160 may include a receiver 166 or a plurality of receivers 166, where each receiver 166 may secure a damping element 170 to the support beam 160. In some examples, the receiver 166 may be located along the rib 162. The damping element 170 may contact both the support beam 160 and the bottom surface 154 of the playing board 150. In addition, each support beam 160 may have a bend or angled region 168 near the connection to the frame 126 that moves the central region 161 of the support beam 160 away from the bottom surface 154 of the playing board 150 to space the upper surface 164 of the support beam 160 away from the bottom surface 154.

The playing board 150 may connect to the base 120 to create a playing surface 152 for the cornhole board assembly 100. The playing board 150 may have a substantially planar top surface 152 to create a playing surface. The playing board 150 may also include a bottom surface 154 and may have a generally rectangular shape with rounded corners. The playing board 150 may have a length of 4 feet and a width of 2 feet and include a circular hole 156 (approximately 6 inches in diameter) extending through the board 150 nearer the rear side 104 than the front side 102 of the cornhole board assembly 100. The playing board 150 may have a constant thickness that rests on top of the flange portions 142 of walls 134, 136, 138, 140 of the frame 126 covers the opening 128. As discussed above, the playing board 150 may be releasably connected with mechanical fasteners, where the playing board 150 may have countersunk or counter bored holes that receive the mechanical fasteners to provide the planar playing surface. The mechanical fasteners may be located at the corners of the board as well as in central regions near the edges of the board 150 to connect to the flange portions 142.

The playing board 150 may be formed from using non-metallic materials and may also include waterproof or water resistant materials or coatings. In some examples, the playing board 150 may be formed from a wooden material, such as bamboo, or other materials. For instance, a playing board 150 may be formed from a plurality of layers of wooden plywood. A playing board formed from this type of wooden layer construction may have a weight of approximately 14.5 pounds, or within a range of 12 to 17 pounds and have a thickness within 0.5 inches and 1 inch. While in other examples, the playing board 150 may be formed from a composite or polymeric material and may have a laminated material that forms the top surface 152. Still in other examples, a playing board 150 may be formed using a high pressure laminate (HPL) made with outer layers of paper that are impregnated with a resin and laminated around a mufti-layer paperboard or cardboard material (i.e. Kraft paper) that is impregnated with a phenolic resin. An HPL playing board may have a weight of approximately 26 pounds, or within a range of 22 and 30 pounds and may have a thickness within 0.4 inches and 0.8 inches. The playing board 150 may have a constant thickness. Yet, in other examples, the playing board 150 may include stiffening ribs along the bottom surface 154 to help provide additional support to the playing board 150. The playing board 150 may also include a protective coating to help prevent damage from water and other outdoor elements. In addition, the coating may also allow for customization such as decals, screen printing, or other custom labels as necessary.

Figure 7:
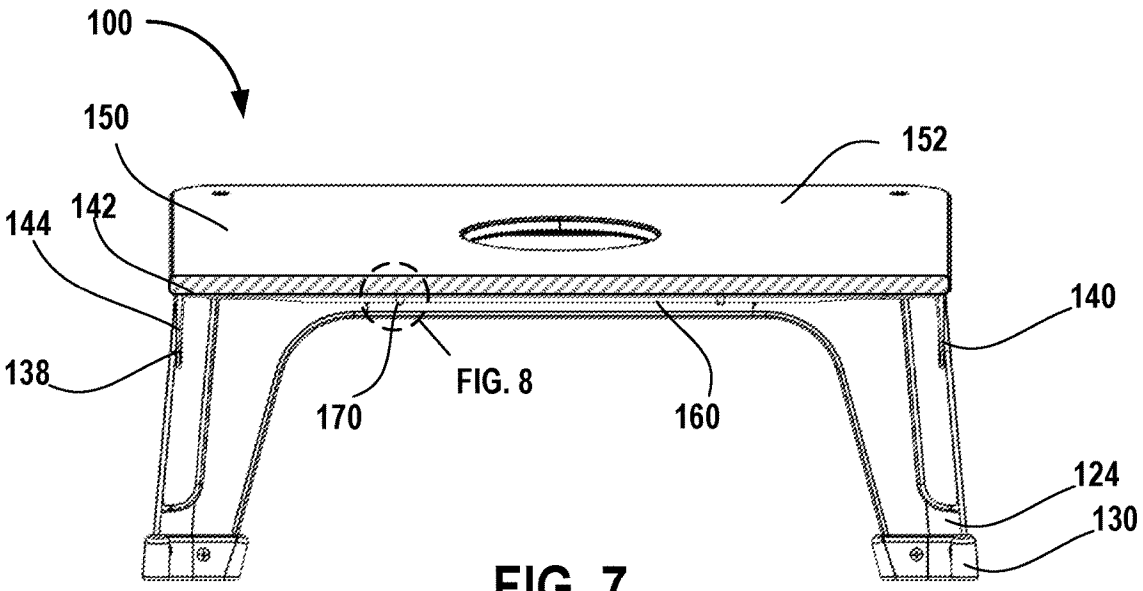
FIG. 7 illustrates front cross-sectional view of the exemplary cornhole board assembly of FIG. 1 along line 7-7 according to one or more aspects described herein.
Figure 8:
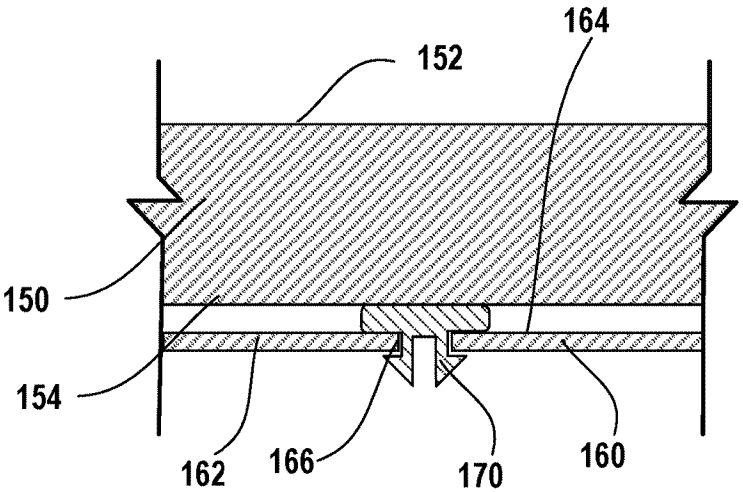
FIG. 8 illustrates an enlarged cross-sectional view of FIG. 7 according to one or more aspects described herein.
Figure 9:
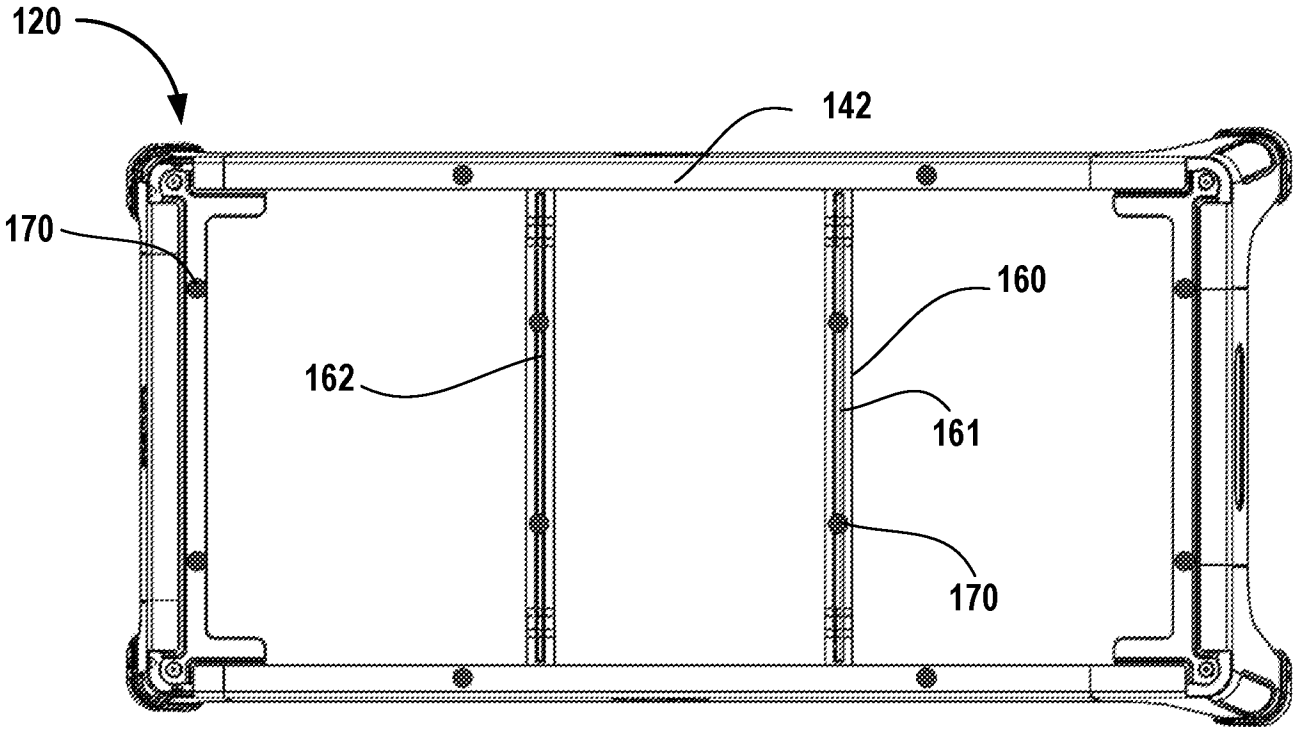
FIG. 9 illustrates a top view of a base of the exemplary cornhole board assembly of FIG. 1 according to one or more aspects described herein.

In particular, as shown in FIGS. 7-9, the plurality of damping elements 170 may be located between the playing board 150 and the base 120. The damping elements 170 may be spaced apart from each other along the base 120 and may be located along the flange portion 142 of the frame walls 134, 136, 138, 140 as well as the support beams 160. The damping elements 170 may be inserted into receivers 166 located along the flange portions 142 and the support beam 160. The receivers 166 on the flange portions 142 may be similar in shape to the receivers 166 on the support beams 160. The damping elements 170 may be secured to the base 120 using a friction fit or other means such as adhesives. Alternatively, the damping elements 170 may be arranged and secured on the bottom surface 154 of the playing board 150. The damping elements 170 may be made from a resilient material, such as an elastomeric or silicone material. In addition, the damping elements 170 may help to adjust the sound and resilience of the playing surface 152. For example, a softer damping element 170 may create a playing surface that causes a bag when it hits the playing surface to slide less or stop quicker, while a harder damping element 170 may cause a bag when it hits the playing surface to slide more or bounce when it impacts the playing surface 152. The damping elements 170 may be formed from a material with a durometer within a range of 10 and 70 Shore A. The damping elements 170 may be arranged in a variety of positions. For example, in FIG. 9, each flange portion 142 and each support beam 160 has two damping elements 170 for a total of twelve damping elements 170 on the cornhole board assembly 100. The number of damping elements 170 may vary from a single damping element to 18 damping elements (3 on each flange portion 142 and support beam 160) to any number depending on the performance characteristic desired. Alternatively, a continuous damping element may be arranged as a strip or multiple strips of resilient material between the bottom surface 154 of the playing board 150 and the upper surfaces of the base 120. The strips of resilient material may also be included between the support beams 160 and the bottom surface 154 of the playing board 150. As an option, the cornhole board assembly 100 may include a combination of strips of resilient material along the some surfaces and damping elements 170 spaced apart in various locations between the bottom surface 154 of the playing board 150 and the upper surfaces of the base 120 and upper surfaces 164 of the support beams 160.

The base 120 that includes the frame 126, the support beams 160, and the legs 122, 124 may be formed from a metallic material such as aluminum, aluminum alloy, carbon steel, stainless steel, or other metallic material. The frame 126, the support beams 160, and the legs 122, 124 may be formed from metallic materials that have a constant thickness, such as sheet metal, that are formed in multiple pieces and then permanently joined together using various techniques such as welding, adhesives, brazing, or other techniques to form a permanent joint. In some examples, the thickness of the sheet metal material may be approximately 1.6 millimeters (mm) or within a range of 1.2 mm and 2.0 mm. The base 120 may also be coated with a powder coat, paint, or other coating as to prevent corrosion or and to give the base a positive aesthetic appearance. In one examples, the powder coating may be a polyester based epoxy resin, with a thickness of approximately 0.7 mm or within a range of 0.5 mm and 0.9 mm. The base member may be approximately 14.5 pounds or within a range of 10 pounds to 20 pounds.

Figure 10:
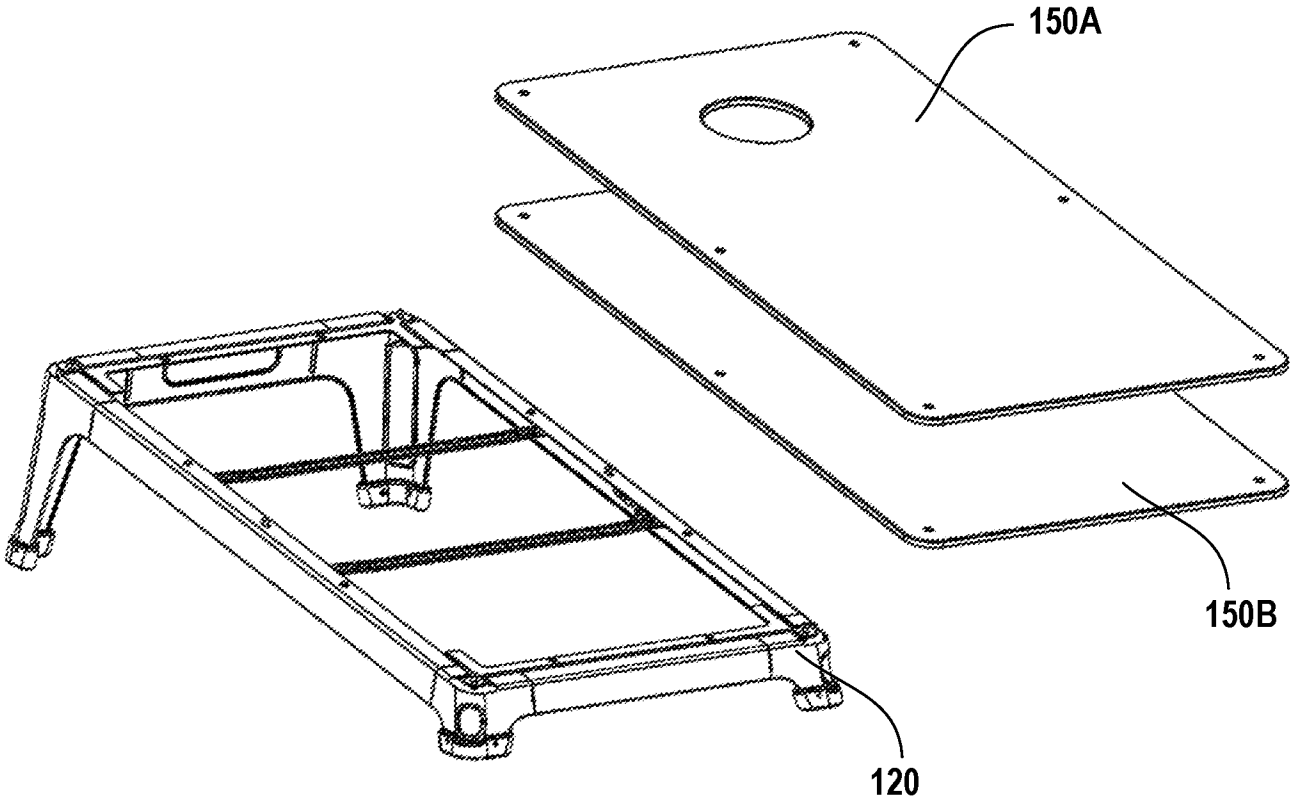
FIG. 10 illustrates an exemplary cornhole board assembly set according to one or more aspects described herein.

Because the playing board 150 is releasably connected, the cornhole board assembly 100 may be configured as a set where a base 120 is paired with a plurality of playing boards 150A, 150B as shown in FIG. 10. A first playing board 150A may be formed from a first non-metallic material or plurality of non-metallic materials, where the first playing board 150A has a first set of playing characteristics that may include a first surface finish, a first stiffness, and a first weight. Similarly, a second playing board 150B may be formed from a second non-metallic material or plurality of non-metallic materials, where the second playing board 150B has a second set of playing characteristics that may include has a second surface finish, a second stiffness, and a second weight. Either the first playing board 150A or the second playing board 150B may be selectably mounted to the base 120 such that when the first playing board 150A is mounted to the base 120, the cornhole board assembly 100 may have a first set of playing characteristics, and when the second playing board 150B is mounted to the base 120, the cornhole board assembly 100 may have a second set of playing characteristics, where the first set of playing characteristics is different than the second set of characteristics. For instance, the first playing board weight may be different than the second playing board weight, and/or the first stiffness may be different than the second stiffness. As an example, the second playing board weight may be at least 1.5 times heavier than the first playing board weight, which may cause the bag to respond differently when it lands on the playing surface. In addition, each playing board 150A, 150B may have a different surface finish or surface roughness to effect the sliding of the bag on the playing surface 152. These different board characteristics may cause the cornhole board assembly 100 to have a different response during game play when a bag impacts the playing surface.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

What is claimed is:

1. A cornhole board assembly comprising:

a base including:

a plurality of legs that support the base, a frame connected to the plurality of legs and having a generally rectangular shape surrounding an opening, wherein the frame comprises a front wall having a first length and a first side wall adjacent to the front wall having a second length, a rear wall opposite the front wall, and a second side wall opposite the first side wall, wherein the second length is longer than the first length, wherein the front wall includes a front flange that extends inward from the front wall toward the opening, wherein the rear wall includes a rear flange that extends inward from the rear wall toward the opening, wherein the first side wall includes a first side wall flange that extends inward from the first side wall toward the opening, wherein the second side wall includes a second side wall flange that extends inward from the second side wall toward the opening, wherein the plurality of legs and the frame are formed from a metallic material, and a playing board comprising a non-metallic material that is releasably connected to the base, wherein the playing board includes a circular hole, the playing board having four corner regions; and a first plurality of damping elements positioned between the frame and the playing board, wherein the first plurality of damping elements are inserted into a first plurality of receivers positioned along the frame, wherein the first plurality of receivers are openings that receive each damping element of the first plurality of damping elements such that each damping element is secured to the receiver with a friction fit, wherein each damping element of the first plurality of damping elements extends through its corresponding receiver of the first plurality of receivers, such that a first portion of each damping element is above its corresponding receiver and a second portion of each damping element is below its corresponding receiver;

wherein a length of the front flange is less than the first length, a length of the rear flange is less than the first length, a length of the first side wall flange is less than the second length, and a length of the second side wall flange is less than the second length such that there is a gap between the frame and the playing board at each of the four corner regions.

2. The cornhole board assembly according to claim 1, wherein the base further includes a support beam extending across the opening from the first side wall to the second side wall, and wherein the support beam includes a bend near a connection to the first side wall to space a central region of the support beam away from a bottom surface of the playing board.

3. The cornhole board assembly according to claim 2, wherein the support beam comprises two support beams extending from the first side wall to the second side wall.

4. The cornhole board assembly according to claim 2, further comprising a second plurality of damping elements positioned between the support beam and the playing board, wherein the second plurality of damping elements are inserted into a second plurality of receivers positioned along the support beam, wherein the second plurality of receivers are openings that receive each damping element of the second plurality of damping elements such that each damping element is secured to the receiver with a friction fit, and wherein each damping element of the second plurality of damping elements extends through its corresponding receiver of the second plurality of receivers, such that a first portion of each damping element is above its corresponding receiver and a second portion of each damping element is below its corresponding receiver.

5. The cornhole board assembly according to claim 4, wherein a first damping element and a second damping element of the second plurality of damping elements are spaced apart from each other along the support beam.

6. The cornhole board assembly according to claim 1, wherein the non-metallic material of the playing board comprises a wooden material.

7. The cornhole board assembly according to claim 1, wherein the non-metallic material of the playing board comprises a polymer material.

8. The cornhole board assembly of claim 1, wherein each damping element of the first plurality of damping elements has a durometer within a range of 10 and 70 Shore A.

9. The cornhole board assembly according to claim 1, wherein the plurality of legs includes a pair of front legs and a pair of rear legs, wherein the pair of front legs are shorter than the pair of rear legs.

10. The cornhole board assembly according to claim 1, wherein each leg of the plurality of legs includes a foot, wherein the foot is formed from an elastomeric material.

11. A cornhole board assembly comprising:

a base including:

a plurality of legs that support the base, a frame connected to the plurality of legs and having a generally rectangular shape surrounding an opening, wherein the frame comprises a front wall having a first length and a first side wall adjacent to the front wall having a second length, a rear wall opposite the front wall, and a second side wall opposite the first side wall, wherein the second length is longer than the first length, wherein the front wall includes a front flange that extends inward from the front wall toward the opening, wherein the rear wall includes a rear flange that extends inward from the rear wall toward the opening, wherein the first side wall includes a first side wall flange that extends inward from the first side wall toward the opening, wherein the second side wall includes a second side wall flange that extends inward from the second side wall toward the opening, wherein the plurality of legs and the frame are formed from a metallic material, and a first plurality of damping elements inserted into a first plurality of receivers positioned along the frame, wherein the first plurality of receivers are openings that receive each damping element of the first plurality of damping elements such that each damping element is secured to a corresponding receiver of the first plurality of receivers with a friction fit, wherein each damping element of the first plurality of damping elements extends through its corresponding receiver of the first plurality of receivers, such that a first portion of each damping element is above its corresponding receiver and a second portion of each damping element is below its corresponding receiver;

a first playing board comprising a first non-metallic material, wherein the first playing board includes a circular hole and has a first set of playing characteristics that includes a first playing board weight, the first playing board having four corner regions; and a second playing board comprising a second non-metallic material, wherein the second playing board includes a circular hole and has a second set of playing characteristics that includes a second playing board weight that is different than the first playing board weight, the second playing board having four corner regions; and wherein either the first playing board or the second playing board is selectably mounted to the base such that when the first playing board is mounted to the base, the cornhole board assembly has the first set of playing characteristics, and when the second playing board is mounted to the base, the cornhole board assembly has the second set of playing characteristics; and wherein the first plurality of damping elements are positioned between the frame and the first playing board or the second playing board that is selectably mounted to the base;

wherein a length of the front flange is less than the first length, a length of the rear flange is less than the first length, a length of the first side wall flange is less than the second length, and a length of the second side wall flange is less than the second length such that there is a gap between the frame and both of the first playing board and second playing board at each of the four corner regions of the first playing board and the second playing board.

12. The cornhole board assembly of claim 11, wherein the base further comprises a support beam extending across the opening from the first side wall to the second side wall, and a second plurality of damping elements positioned between the support beam and the first playing board or the second playing board that is selectably mounted to the base, wherein the second plurality of damping elements are received in a second plurality of receivers positioned along the support beam.

13. The cornhole board assembly of claim 12, wherein the support beam comprises two support beams extending across the opening from the first side wall to the second side wall.

14. The cornhole board assembly of claim 11, wherein the second playing board weight is at least 1.5 times heavier than the first playing board weight.

15. The cornhole board assembly of claim 11, wherein the first non-metallic material comprises a wooden material.

16. The cornhole board assembly of claim 11, wherein the second non-metallic material comprises a polymer material.

17. A cornhole board assembly comprising:

a base including:

a plurality of legs that support the base, wherein the plurality of legs includes a pair of front legs and a pair of rear legs, wherein the pair of front legs are shorter than the pair of rear legs;

a frame connected to the plurality of legs and having a generally rectangular shape surrounding an opening, wherein the frame comprises a front wall having a first length and a first side wall adjacent to the front wall having a second length, a rear wall opposite the front wall, and a second side wall opposite the first side wall, wherein the second length is longer than the first length, wherein the front wall includes a front flange that extends inward from the front wall toward the opening, wherein the rear wall includes a rear flange that extends inward from the rear wall toward the opening, wherein the first side wall includes a first side wall flange that extends inward from the first side wall toward the opening, wherein the second side wall includes a second side wall flange that extends inward from the second side wall toward the opening, a first support beam extending across the opening from the first side wall to the second side wall;

a playing board that is releasably connected to the base, wherein the playing board includes a circular hole, the playing board having four corner regions;

wherein the support beam includes a bend near a connection to the first side wall to space a central region of the support beam away from a bottom surface of the playing board;

a first plurality of damping elements positioned between the frame and the playing board, wherein the first plurality of damping elements are inserted into a first plurality of receivers positioned along the frame, wherein the first plurality of receivers are openings that receive each damping element of the first plurality of damping elements such that each damping element is secured to a corresponding receiver of the first plurality of receivers with a friction fit, wherein each damping element of the first plurality of damping elements extends through its corresponding receiver of the first plurality of receivers, such that a first portion of each damping element is above its corresponding receiver and a second portion of each damping element is below its corresponding receiver; and a second plurality of damping elements positioned between the first support beam and the playing board, wherein the second plurality of damping elements are inserted into a second plurality of receivers positioned along the first support beam, wherein the second plurality of receivers are openings that receive each damping element of the second plurality of damping elements such that each damping element is secured to a corresponding receiver of the second plurality of receivers with a friction fit, wherein each damping element of the second plurality of damping elements extends through its corresponding receiver of the second plurality of receivers, such that a first portion of each damping element is above its corresponding receiver and a second portion of each damping element is below its corresponding receiver;

wherein a length of the front flange is less than the first length, a length of the rear flange is less than the first length, a length of the first side wall flange is less than the second length, and a length of the second side wall flange is less than the second length such that there is a gap between the frame and the playing board at each of the four corner regions.

18. The cornhole board assembly of claim 17, wherein the plurality of legs and the frame are formed from a metallic material.

19. The cornhole board assembly of claim 17, further comprising a second support beam extending substantially parallel to the first support beam.

20. The cornhole board assembly of claim 17, wherein a first damping element and a second damping element of the second plurality of damping elements are spaced apart from each other along the first support beam.

* * * * *